US008944517B2

(12) United States Patent
Franzmann et al.

(10) Patent No.: US 8,944,517 B2
(45) Date of Patent: Feb. 3, 2015

(54) SELF-PROPELLED CONSTRUCTION MACHINE

(71) Applicant: Wirtgen GmbH, Windhagen (DE)

(72) Inventors: Dirk Franzmann, Hennef (DE); Christian Berning, Brühl (DE); Herbert Ley, St. Katharinen (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 13 days.

(21) Appl. No.: 13/788,897

(22) Filed: Mar. 7, 2013

(65) Prior Publication Data

US 2013/0341996 A1 Dec. 26, 2013

(30) Foreign Application Priority Data

Jun. 25, 2012 (DE) ..... 10 2012 012 397

(51) Int. Cl.
*E01C 23/088* (2006.01)
*E01C 23/12* (2006.01)

(52) U.S. Cl.
CPC ..... *E01C 23/127* (2013.01); *E01C 23/088* (2013.01)
USPC ..... 299/1.5; 299/39.6

(58) Field of Classification Search
CPC ..... E01C 23/127; E01C 19/00; E02F 9/245; B28D 7/005
USPC ..... 299/1.4, 1.5, 39.1, 39.3, 39.4, 39.6
See application file for complete search history.

(56) References Cited

U.S. PATENT DOCUMENTS

| | | | | |
|---|---|---|---|---|
| 4,221,434 | A * | 9/1980 | Swisher et al. | 299/39.6 |
| 4,723,867 | A | 2/1988 | Wirtgen | |
| 5,607,205 | A * | 3/1997 | Burdick et al. | 299/1.5 |
| 6,623,083 | B1 * | 9/2003 | Risi | 299/39.4 |
| 7,387,465 | B2 * | 6/2008 | Hall et al. | 404/94 |
| 7,530,641 | B2 | 5/2009 | Berning et al. | |

(Continued)

FOREIGN PATENT DOCUMENTS

| | | | |
|---|---|---|---|
| DE | 102006024123 | A1 | 11/2007 |
| DE | 102007044090 | A1 | 4/2009 |

(Continued)

OTHER PUBLICATIONS

Co-pending U.S. Appl. No. 13/788,962, filed Mar. 7, 2013.

*Primary Examiner* — David Bagnell
*Assistant Examiner* — Michael Goodwin
(74) *Attorney, Agent, or Firm* — Waddey & Patterson, P.C.; Lucian Wayne Beavers

(57) ABSTRACT

A self-propelling construction machine has a machine frame, an operating drum and a drum housing enclosing the operating drum. The drum housing is closed off by a front and/or rear sealing element and/or lateral sealing element. The construction machine has a mechanism for raising and lowering the at least one sealing element. A measuring unit is configured so that the measuring unit measures the forces acting on the sealing element when the sealing element encounters an obstacle. A control unit generates a control signal for raising the sealing element when the force measured by the measuring unit is larger than a predetermined limit value, so that the sealing element is raised.

20 Claims, 11 Drawing Sheets

(56) References Cited

U.S. PATENT DOCUMENTS

| | | | | |
|---|---|---|---|---|
| 7,887,142 | B2 * | 2/2011 | Hall et al. | 299/1.5 |
| 8,047,741 | B2 | 11/2011 | Von Schonebeck et al. | |
| 8,246,270 | B2 * | 8/2012 | Berning et al. | 404/84.1 |

FOREIGN PATENT DOCUMENTS

| | | | |
|---|---|---|---|
| DE | 102010014529 | A1 | 10/2011 |
| EP | 1012396 | B1 | 6/2002 |
| EP | 2050875 | A2 | 4/2009 |

* cited by examiner

SELF-PROPELLED CONSTRUCTION MACHINE

BACKGROUND OF THE INVENTION

1. Field of the Invention

The invention relates to a self-propelled construction machine, in particular road milling machine, recycler or stabiliser, with a machine frame and an operating mechanism, wherein the operating mechanism comprises an operating drum and a drum housing surrounding the operating drum.

2. Description of the Prior Art

With the known road milling machines, the road surface can be milled true to contour and evenly. The known road milling machines have a milling mechanism, which comprises a milling drum for milling off the material. With a rear loader road milling machine, the milled material is fed to the following truck over the rear of the milling machine.

The so-called stabilisers or recyclers should be differentiated from road milling machines; by addition of binding agents to unstable ground, for example loose soil (stabiliser) or a damaged roadway (recycler), these produce a stable base that is suitable for later overlaying with a roadway.

Road milling machines and stabilisers or recyclers have in common an operating mechanism with an operating drum and a drum housing surrounding the operating drum, that is closed by at least one sealing element, that is also described as stripping element, located behind the operating drum when seen in the operating direction. Apart from the rear sealing element, road milling machines have further a sealing element, also described as hold-down device, located in front of the milling drum. In addition to the hold-down device and the stripper, road milling machines comprise a right and left edge protector extending in the operating direction, which seal the drum housing laterally.

In practice, all sealing elements basically confront the problem that the sealing element can strike obstacles in uneven areas. The sealing element must therefore be adjustable in height. This problem is encountered particularly with front and rear sealing elements extending transverse to the operating direction. The problem of tilting is encountered, especially with the rear sealing element, since the rear sealing element is employed in the operating direction and is generally fitted with disc-shaped hard metal elements at the lower edge. This problem is made still worse with the rear sealing element by the fact that this sealing element is generally subjected to a pressure.

The road milling machine with a front hold-down device and a rear stripper element is known, for example, from EP 2 050 875 A2. The road milling machine has a tracking member for adjusting the height of the hold-down device, with which the hold-down device is connected by means of a control lever to an articulated joint so that, when the tracking member strikes an obstacle, the tracking member is raised.

U.S. Pat. No. 4,723,867A describes a road milling machine, the drum housing of which has a front and a rear sealing element. Both sealing elements can be adjusted in height, so that the milling drum is accessible.

SUMMARY OF THE INVENTION

The invention has the object of creating a self-propelled construction machine, with which the drum housing is sealed at the front and/or rear and/or laterally in the operating direction without risk of a blockage due to a sealing element striking an obstacle.

According to the invention, this object is achieved with the features of the independent claims. The dependent claims relate to preferred embodiments of the invention.

The invention relates to a self-propelled construction machine, in particular a road milling machine, stabiliser or recycler, that has at least one front and/or at least one rear sealing element and/or at least one lateral sealing element.

The sealing element is any element with which the drum housing is closed off to the ground. However, this does not mean that the drum housing is tightly sealed. A mechanism for raising and lowering is associated with the respective sealing element, or the respective sealing elements, with which the sealing element or the sealing elements rest on the ground with a predetermined force or are pressed on the ground. Where a construction machine has a front and a rear sealing element, two mechanisms are provided, for example, for raising and lowering.

It is irrelevant to the principle of the function of the invention, how the mechanism for raising and lowering the at least one sealing element is provided, as long as the sealing element rests on the ground with a predetermined force, if this sealing element is not raised. The contact force of the sealing element can be the force due to the weight of the sealing element. However, the sealing element can be pressed on the ground with a contact force which is greater than the force due to the weight of the sealing element.

The construction machine in accordance with the invention is characterised in that the mechanism for raising and lowering the sealing element has a measuring unit, which is configured so that the measuring unit measures the force acting on the sealing element when the measuring unit comes into contact with an obstacle. Furthermore, the mechanism comprises a control unit which is configured so that the control unit generates a control signal for raising the sealing element. When the force measured by the measuring unit is greater than a predetermined limit value, that the sealing element is raised.

The force measured with the measuring unit is preferably the essentially horizontal force component acting on the sealing element when it strikes an obstacle. However, it is also possible that the measured force has a vertical component. It is also not necessary to determine the absolute force. It is sufficient for the force to be measured quantitatively. The force also need not be directly measured as its actual physical unit but, converted by means of any desired physical principles, can be measured as another physical unit, such as pressure, distance or the like if it is simpler to record these physical variables.

The advantage of the sealing element in accordance with the invention is that obstacles in the operating direction of the construction machine are detected where the force acting on the sealing element exceeds a limit value. When this is the case, the sealing element is automatically raised. The sealing element is only raised until the measured force is again below the limit value. In this case, it is assumed that the obstacle has been negotiated and it is possible to return to the original operating state or a preselected other operating state. The limit value for the measured force should be calculated so that the sealing element is not raised where forces are very small. When the sealing element is raised, the sealing element can remain in the raised position. For example, the sealing element remains in the raised position when the obstacle is a step. However, the sealing element can be lowered again if the obstacle is not a step. If, before raising, the mechanism for raising and lowering the sealing element has found the so-called floating state in the operating mode in which the sealing element is held on the ground with a predetermined bearing force, the mechanism for raising and lowering the sealing element can return to the floating state, for example, when the measured force is below the predetermined limit value again. Then the sealing element can automatically move downwards when the height of the terrain decreases, i.e. the sealing element can follow the contour of the terrain again. However, the mechanism for raising and lowering the sealing element can also switch to a preselected alternative operating state when the measured force is below the predetermined limit value again, e.g. to an operating state in which the sealing element is lowered with the assistance of a restoring force.

In a preferred embodiment, the control unit generates a second control signal if the force is lower than the predetermined limit value, so that the mechanism for raising and lowering switches to an operating state in which the sealing element maintains a position or can be lowered. The lowering of the sealing element can take place solely under the action of gravity or can be assisted by the mechanism for raising and lowering sealing element with an additional restoring force. The decisive factor is that the sealing element rests on the ground again with the predetermined contact force.

In a preferred embodiment, the mechanism for raising and lowering the sealing element comprises one or more piston/cylinder arrangements where their cylinders have an articulated connection to the machine frame and their pistons have an articulated connection to the sealing element or their cylinders have an articulated connection to the sealing element and their pistons have an articulated connection to the machine frame. The piston/cylinder arrangement can be operated hydraulically or pneumatically. However, an electric motor drive is also possible. The sub-assemblies required for this purpose are state of the art.

The automatic raising and lowering of the sealing element relieves the machine driver of a task. Furthermore, the stability of the machine is improved and it is able to move forward at a constant rate without there being a risk that the machine will be damaged by obstacles. In addition, wear on the sealing element is reduced. Control of the sealing element in accordance with the invention can always be switched off during operation of the construction machine or also by the machine driver, so that raising and lowering of the sealing element can be controlled manually.

A further preferred embodiment of the invention provides an impact element, in particular on the front or rear sealing element, which extends downwards beyond the lower edge of the sealing element. The impact element is preferably a plate-like element, which extends over the width of the sealing element. However, it is also possible for the impact element to extend only over part of the width of the sealing element.

In a particularly preferred embodiment, particularly of the front or rear sealing element, an upper part of the impact element is fastened to the sealing element under a resilient preload so that, on impact with an obstacle, the impact element is displaced from a first position in which the upper part of the impact element abuts the sealing element, to a second position in which the upper part of the impact element is spaced from the sealing element. The impact element can either be guided linearly or can be fastened so as to pivot on the sealing element. It is preferred that the impact element alters its position so that the impact on an obstacle can be detected.

In a further, particularly preferred embodiment, the upper part of the impact element can be displaced on an axis which is perpendicular to the plane of the sealing element. However, the impact element can also be guided on an axis that is oblique to the plane of the sealing element.

The impact element can be guided on the sealing element by at least one guide pin, which extends through a bore in the impact element. Preferably, several guide pins are provided, spaced over the width of the sealing element. The guide pin preferably has a screw thread and the impact element is preferably screwed on with a screw, whereby a spring is interposed between the screw and the impact element, so that the impact element is spring-loaded against the sealing element. The spring load can be adjusted by tightening and untightening the screw.

The measuring unit has at least one sensor detecting the position of the impact element, preferably a distance sensor, with which the deflection or displacement of the impact element can be detected when it strikes an obstacle. In the simplest case, the distance sensor can be a contact switch that is actuated by the impact element.

In a further preferred embodiment of the invention, the drum housing is closed off by two sealing elements located behind the operating drum when seen in the operating direction of the construction machine, wherein two mechanisms are provided for raising and lowering the sealing elements, so that the two sealing elements is can be raised independently of one other on impact with an obstacle. In this embodiment, the sealing elements each extend over half of the operating width of the operating drum. An impact element is again associated with each sealing element to detect the impact force on an obstacle.

The embodiment with two sealing and two impact elements has the advantage that only one of the two sealing elements is raised when an obstacle is encountered, so that the one on the other side of the drum housing remains closed. This is a particular advantage when there is a risk of the impact element striking an obstacle on the outside or inside of the bend, when a turning operation is performed.

BRIEF DESCRIPTION OF THE DRAWINGS

In the following, an example of an embodiment of the invention is explained in detail with reference to the drawings.

These show.

DETAILED DESCRIPTION

Figure 1:
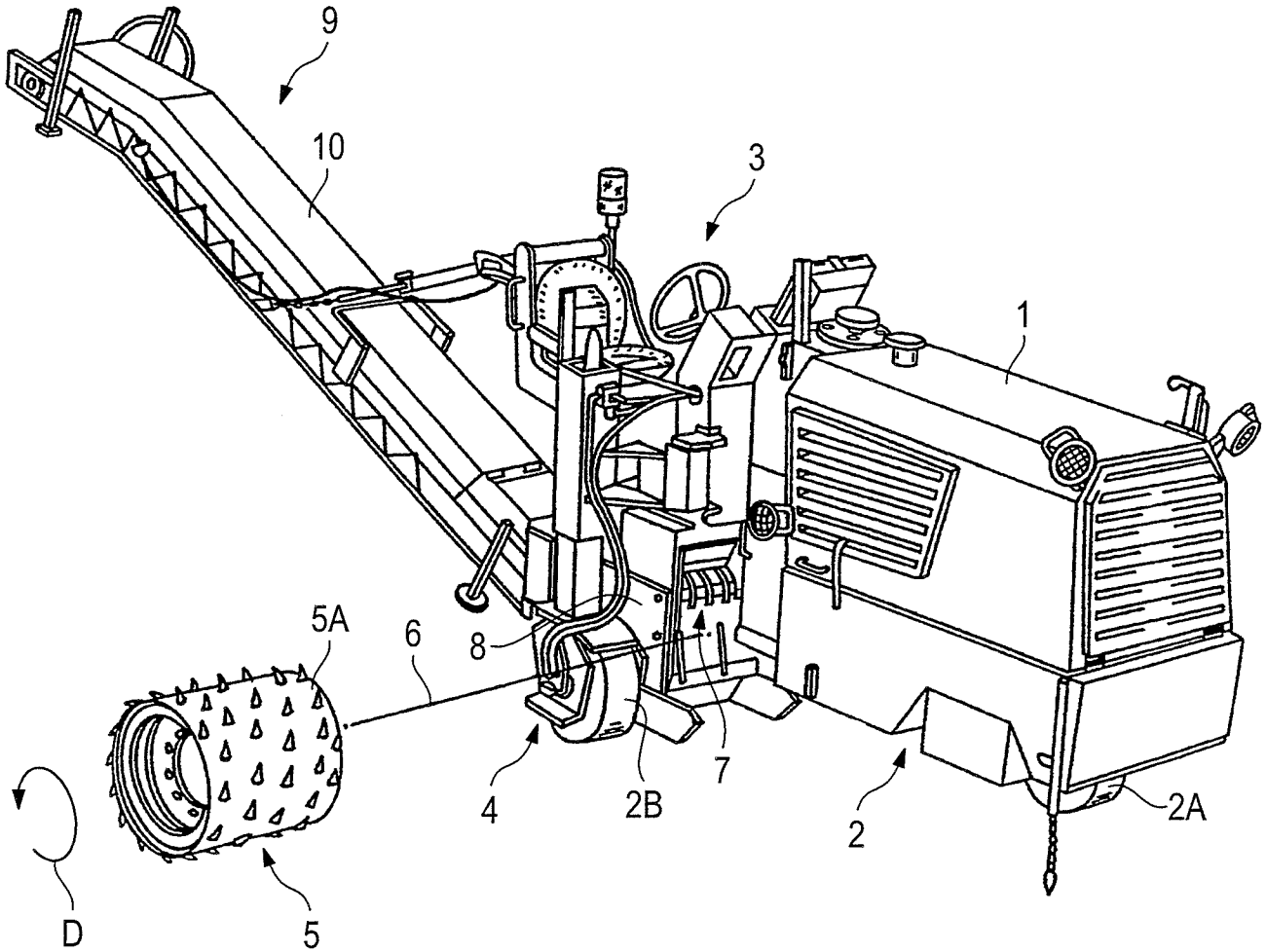
FIG. 1 a self-propelled construction machine in accordance with the invention in a perspective view, FIG. 2 a simplified schematic representation of the drum housing surrounding the operating drum of the construction machine, together with the machine frame, wherein a sealing element closing off the drum housing in front of the operating drum, when seen in the operating direction, is in a first operating position, FIG. 3 the drum housing, wherein the front sealing element is in a second operating position, FIG. 4 the drum housing, wherein the front sealing element is in a third operating position, FIG. 5 a schematic representation of the drum housing, together with the operating drum, wherein the front sealing element is in a raised position, FIG. 6 a schematic representation of the drum housing, together with the operating drum, wherein the sealing element is in a lowered position, FIG. 7 a section through a guide element and a mounting element of the guide of the front sealing element, FIG. 8 the device for raising and lowering the front sealing element in schematic representation, FIG. 9A a schematic representation of a sealing element sealing the drum housing behind the operating drum in the operating direction and a device for raising and lowering the rear sealing element, wherein the sealing element rests on the ground, FIG. 9B a schematic representation of the rear sealing element, wherein the sealing element strikes an obstacle, FIG. 9C a schematic representation of the rear sealing element, wherein the sealing element is raised, FIG. 10A a schematic representation of a sealing element closing off the drum housing laterally, wherein the sealing element rests on the ground, FIG. 10B a schematic representation of the lateral sealing element, wherein the sealing element strikes an obstacle, FIG. 11 a simplified hydraulic circuit, which shows the hydraulic cylinder of the front or lateral sealing element, FIG. 12 a simplified hydraulic circuit, which shows the hydraulic cylinder of the rear sealing element, FIG. 13 the control system for the mechanisms for raising and lowering the front and rear sealing element, together with the lateral sealing elements, in very simplified representation.

FIG. 1 shows in perspective a road milling machine, as an example of a construction machine, specifically a rear loader road milling machine. The road milling machine comprises a machine frame 1, which is supported by a chassis 2. The chassis 2 has a front wheel 2A and two rear wheels 2B, when seen in the operating direction. The operator's platform 3 is in the rear part of the machine frame. The milling mechanism 4 of the road milling machine is underneath the operator's platform 3.

The milling mechanism 4 comprises a milling drum 5, with cutting tools 5A spaced around its periphery. The milling drum 5 is positioned in a milling drum housing 7A to rotate about an axis 6 mounted transverse to the operating direction of the milling machine. The milling drum 5 rotates in the milling drum housing 7A in a predetermined direction of rotation D. In the present example, the milling drum 5 rotates in a counter-clockwise direction. The housing 7A enclosing the milling drum 5 has a discharge opening at the rear, when seen in the operating direction. The milling drum housing is closed off by side plates 8 on the longitudinal sides. The transport arrangement 9 on the milling drum housing 7A comprises a conveyor belt 10 for conveying the milled material, which can be received by a truck driven behind the milling machine.

In the following, the milling drum housing 7A accommodating the milling drum 5 is described in detail with reference to FIGS. 2 to 8.

Figure 3:
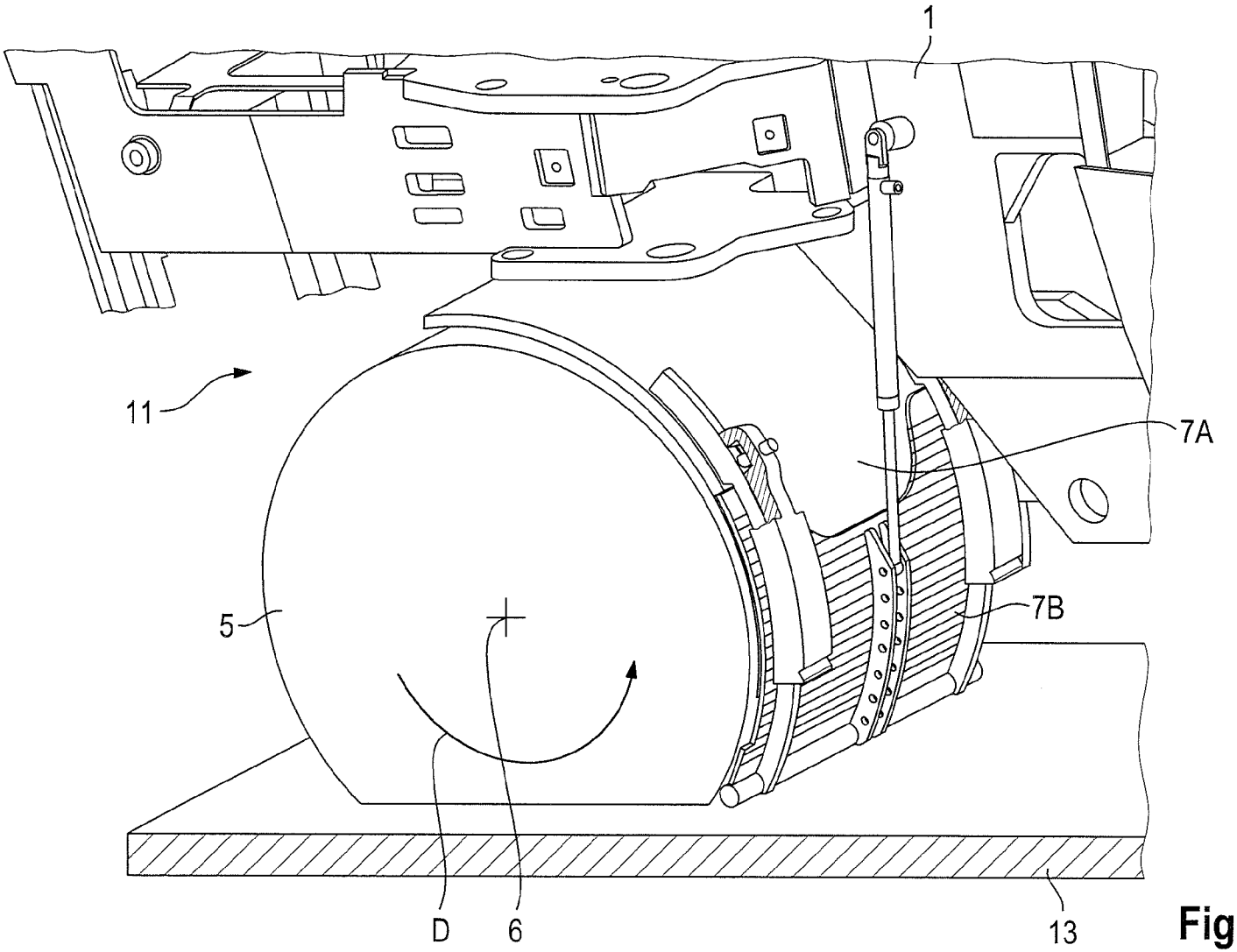
Figure 4:
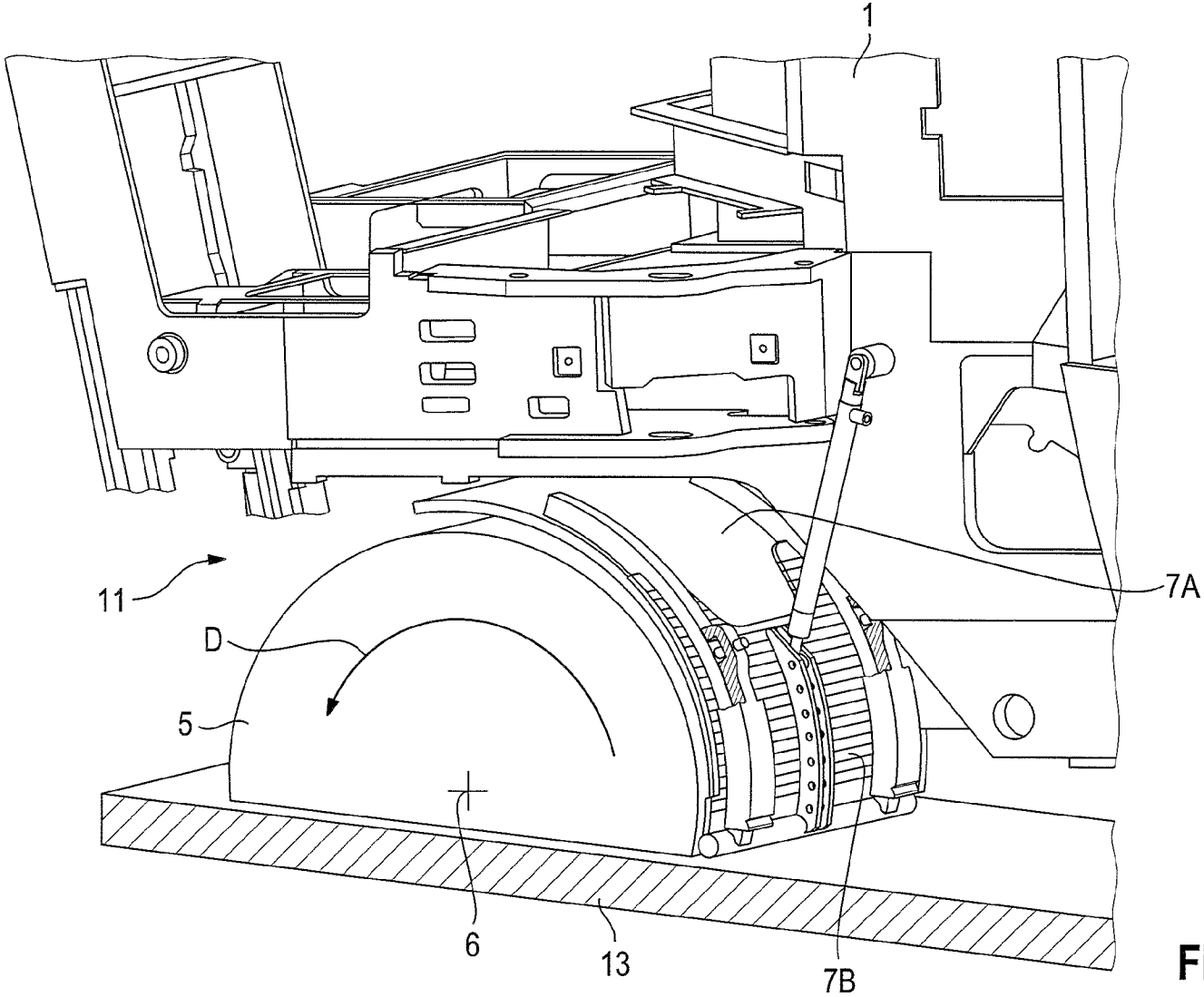
Figure 5:
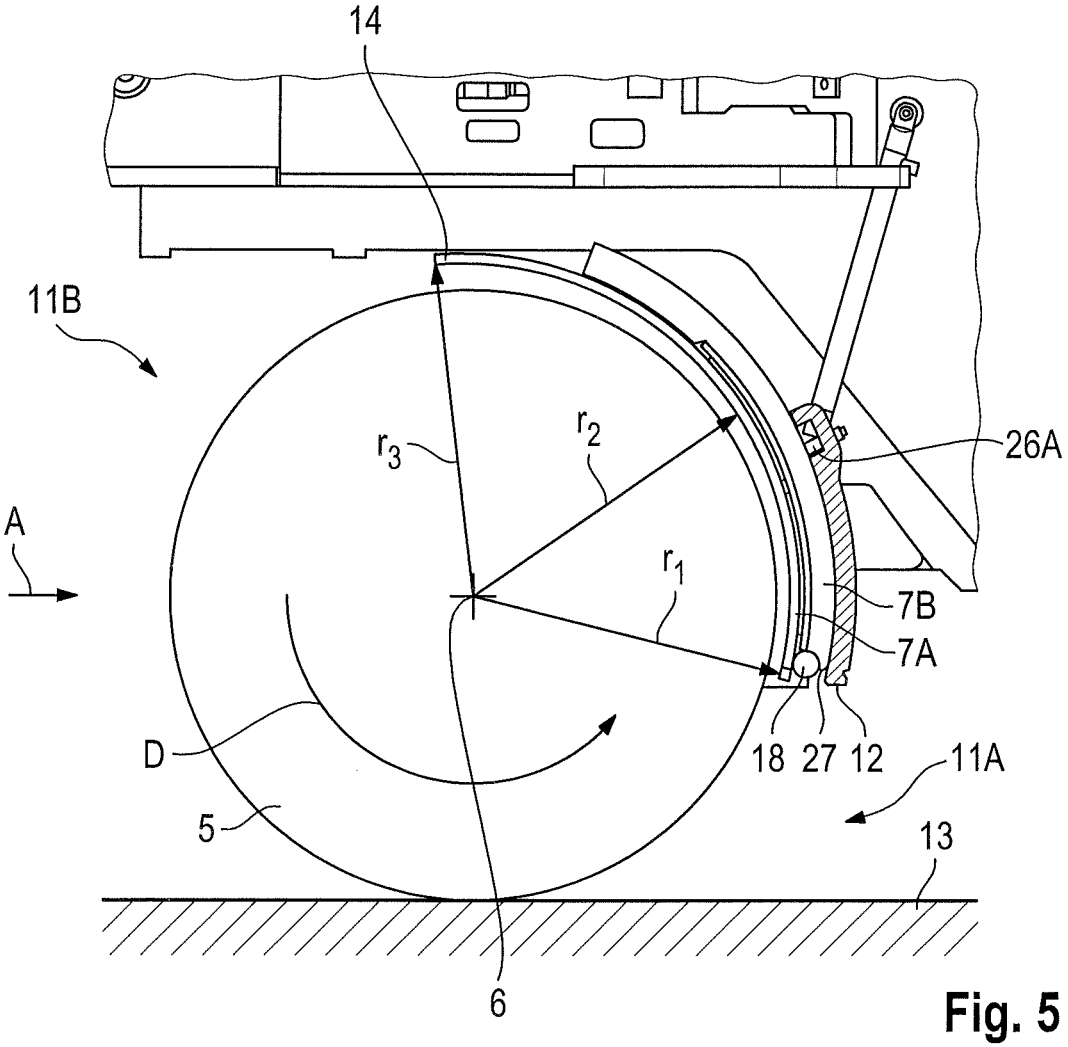

The milling drum housing 7A is a fixed housing part 7A that is permanently attached to the machine frame 1. The fastening members for the milling drum housing 7A are not shown in the Figures. In the Figures, the milling drum 5 is represented schematically by a cylindrical body that encloses the tips of the tools 5A of the milling drum 5. The milling drum housing 7A extends beyond the width of the milling drum 5 on both sides. It encloses the milling drum 5 up to an aperture 11A in front of the milling drum when seen in the operating direction and an aperture 11B behind the milling drum when seen in the operating direction (FIG. 5). The front aperture 11A in the operating direction is closed by a sealing element, which is called hold-down device 7B in the following. The rear aperture 11B is closed by a rear sealing element located behind the milling drum when seen in the operating direction but not shown in FIGS. 1 to 8. This sealing element is also described as stripper. FIGS. 1 to 8 also do not show the lateral sealing elements, which are known by the name of edge protector.

Figure 2:
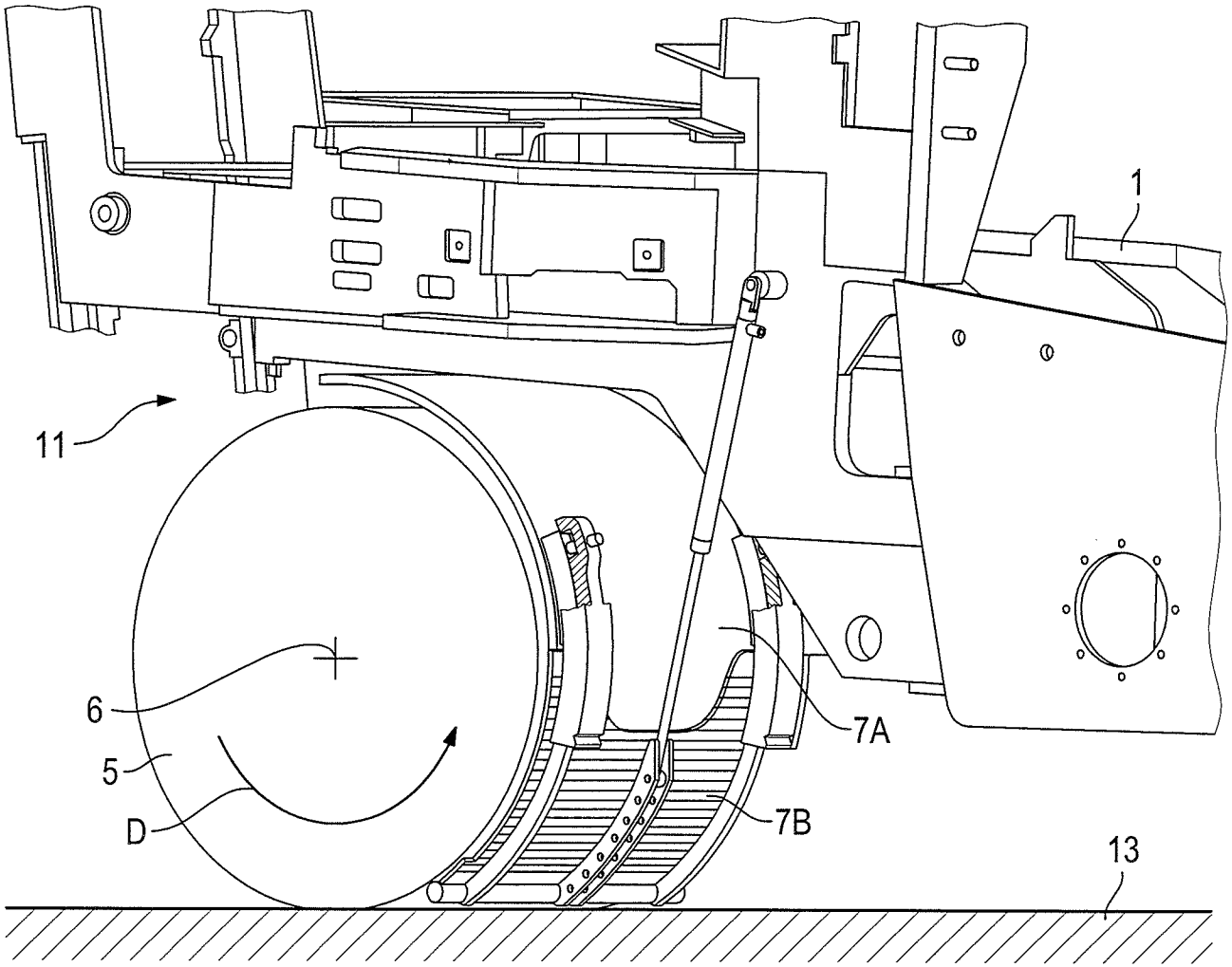

The height of the hold-down device 7B can be adjusted according to the milling depth. FIGS. 2 to 4 show how the milling drum penetrates into the material to be removed in the vertical direction. While the milling drum is penetrating into the material, the hold-down device 7B is moved from a first position, shown in FIG. 2, in which the hold-down device 7B is fully lowered, into a second position, in which the hold-down device is fully raised (FIG. 4). The maximum milling depth is obtained in this position. FIG. 3 shows a middle position of the hold-down device 7B with a smaller milling depth. In the present embodiment, the closed milling drum housing 7A along with the hold-down device 7B completely surrounds the milling drum 5 over a circumferential angle of approximately 180°.

Figure 6:
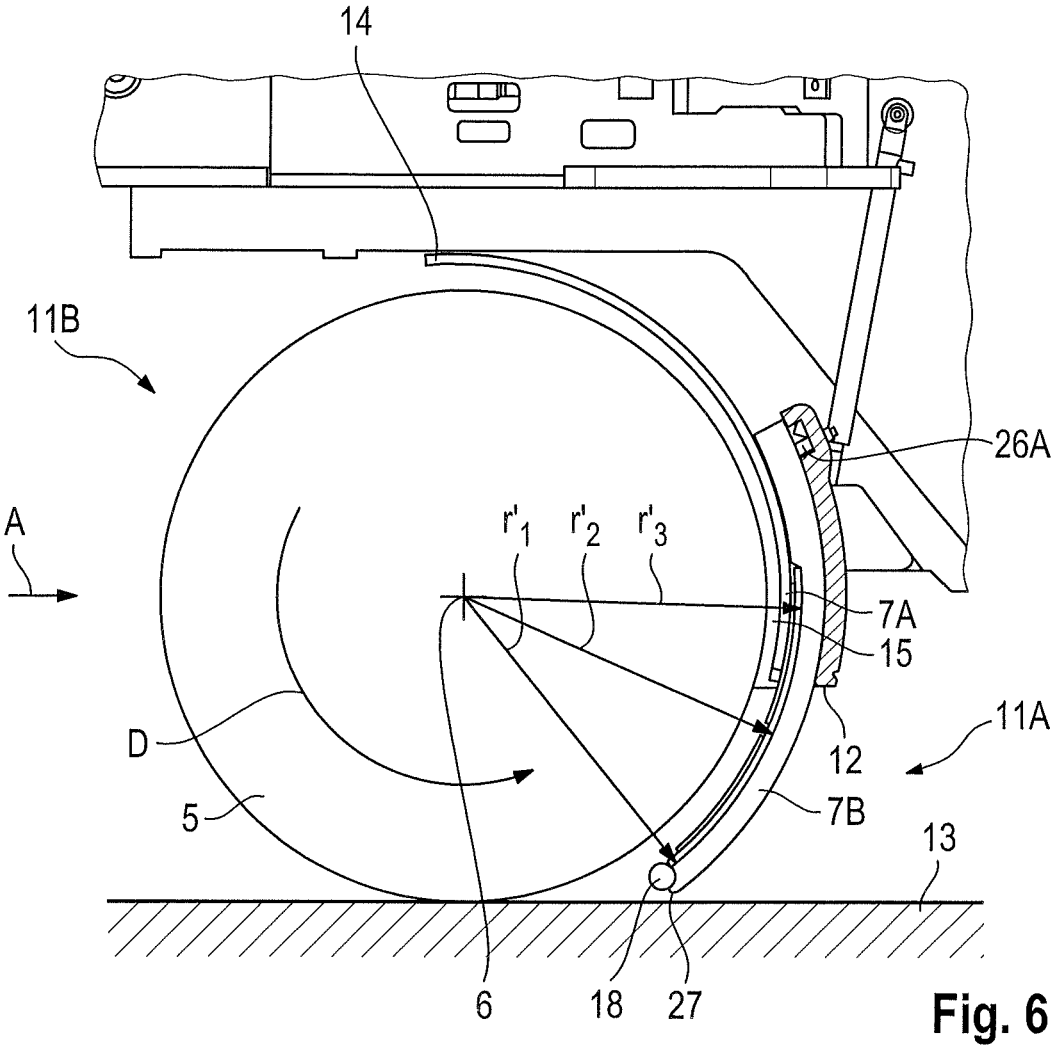

FIGS. 5 and 6 show a sectional view in which the hold-down device 7B is in the raised position (FIG. 5) and in the lowered position (FIG. 6). The hold-down device 7B closes the aperture pointing in the operating direction between the lower edge 27 of the hold-down device 7B and the surface of the road pavement material 13 to be removed.

On both sides of the hold-down device 7B, there is a guide rail 15A, 15B on the outer side, extending upwards over the periphery 15A, 15B. The guide rails 15A and 15B are guided in mounting elements 16A and 16B, which are fastened on the machine frame 1. The fastening for the mounting elements is not shown in FIG. 5 or FIG. 6.

Figure 7:
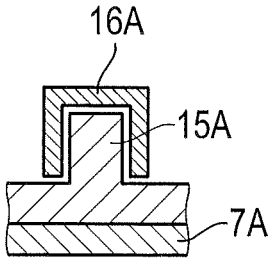

FIG. 7 shows a section through the guide rails 15A, 15B and mounting elements 16A, 16B. The mounting elements 16A, 16B have a U-shaped cross-section, in which the guide rails 15A, 15B are longitudinally displaceable. Since the mounting elements 16A, 16B enclose the guide rails 15A, 15B, the guide rails are secured in the axial and radial directions. If the hold-down device 7B is in the lowered position, the portions of the guide rails 15A, 15B extending upwards are supported on the milling drum housing 7A. This allows larger forces to be absorbed.

At its lower edge 27, the hold-down device 7B has a sliding element 18, extending along the lower edge, which can be a sliding bar. The hold-down device 7 slides with the sliding element 18 on the surface of the road surface cover 13. In doing so, the hold-down device 7B is supported on the road pavement, solely due to its weight. When the milling drum 5 penetrates into the road surface in a vertical direction, the hold-down device 7B moves upwards in the guide.

Figure 8:
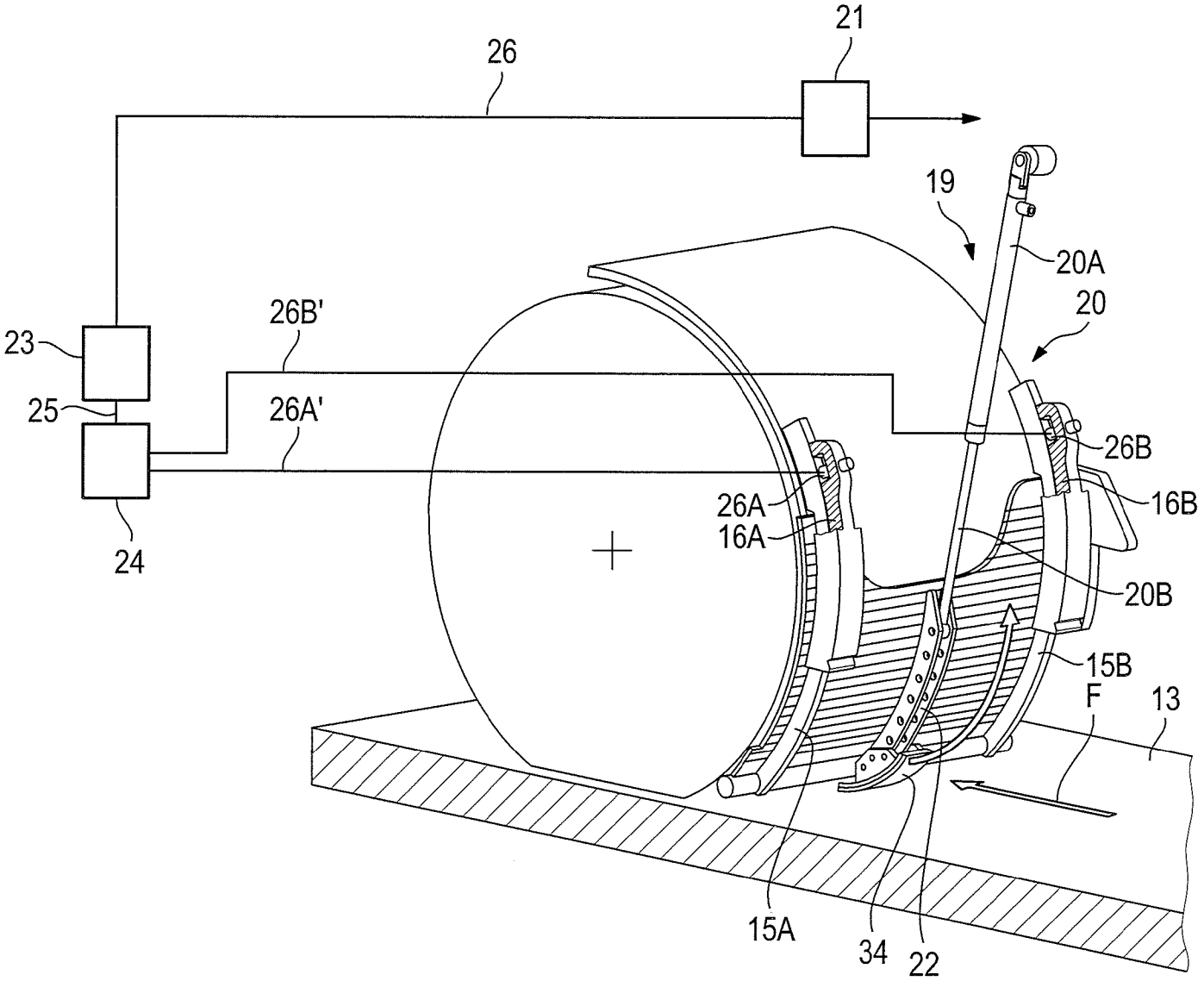

The road milling machine has a mechanism 19 for raising and lowering the hold-down device 7B, comprising a piston/cylinder 20. The piston/cylinder arrangement 20 is operated by a hydraulic unit 21, shown only in outline, which supplies a hydraulic fluid to the cylinder 20A of the piston/cylinder arrangement 20 (FIG. 8).

The cylinder 20A of the piston/cylinder arrangement 20 is flexibly connected to the machine frame 1 and the piston 20B is flexibly connected to the upper end of a U-shaped profile element 22, which is fastened to the hold-down device 7B. The hold-down device 7B can be raised and lowered by admitting hydraulic fluid to the cylinder 20A.

The mechanism 19 for raising and lowering the hold-down device 7B further has a control unit 23 and a processing unit 24, which are connected together by means of a data line 25. The control unit 23, which is connected to the hydraulic unit 21 by a control line 26, controls the hydraulic unit, so that the piston/cylinder arrangement 20 keeps the hold-down device 7B in contact with the ground with a predetermined downwards force. For example, the hydraulic unit 21 can release the piston in the cylinder, so that the hold-down device 7B rests on the ground with its weight if the hold-down device 7B is not raised when it strikes an obstacle.

The mechanism 19 for raising and lowering the hold-down device 7B further comprises a measuring unit 26 for measuring the force exerted on the hold-down device 7B on impact with an obstacle. Preferably, only the horizontal force component acting on the hold-down device is measured by the measuring unit 26.

The processing unit 24 compares the impact force measured by the measuring unit 26 with a predetermined limit value. When the impact force is greater than the limit value, the control unit 23 generates a first control signal for the hydraulic unit 21 to raise the hold-down device 7B, so that the hydraulic unit 21 actuates the piston 20B of the piston/cylinder unit 20. The hold-down device 7B is raised by the piston/cylinder unit 20 until the measured impact force is again less than the predetermined limit value. When the impact force is smaller than the limit value, the control unit 23 generates a second control signal for the hydraulic unit 21, with which the piston/cylinder arrangement 20 is actuated once more to lower the hold-down device 7B again until the lower edge 27 the hold-down device 7B again rests on the ground with the predetermined downwards force, or the hold-down device maintains its current position, for example, if the obstacle is a step. Alternatively, the piston/cylinder arrangement 20 can also release the hold-down device 7B, so that the hold-down device moves downwards in the guide under its own weight or rests on the step under its weight. Since the force acting on the hold-down device is compared with a predetermined limit value, this completely prevents the height of the hold-down device being adjusted due to smaller impacts with the material to be milled off.

The measuring unit 26 has two sensors 26A, 26B, for measuring the impact force, positioned between the mounting elements 16A, 16B and the guide rails 15A, 15B, in the area in which the guide rails extend upwards beyond the hold-down device 7B. The sensors 26A, 26B are connected to the processing unit 24 by signal lines 26A' and 26B'. When an essentially horizontal force acts on the hold-down device, the ends of the guide rails exert a contact pressure on the ends of the mounting elements or a slight tilting movement within the existing clearance, which is measured by the two sensors 26A, 26B. The processing unit 24 processes the measurement signals of the two sensors. Either only one or the other measurement signal can be processed, or both measurement signals together. For example, the two measurement signals can be averaged. Suitable pressure sensors and the processing of the measurement signals are part of the state of the art. However, it is also possible for the sensors to be positioned, not between the mounting elements 16A, 16B and guide rails 15A, 15B, but on the outside of the mounting elements 16A, 16B, in order to detect the tilting movement of the mounting elements 16B.

A skid 34 can also be provided on the hold-down device, to support the upwards movement and to introduce the force on impact with an obstacle, pushing the hold-down device upwards.

Apart from the mechanism 19 described above for raising and lowering the front sealing element, the milling machine also has a mechanism for raising and lowering of the rear sealing element or the lateral sealing elements, not shown in FIGS. 1 to 8, which has the same structure.

An alternative embodiment of the mechanism 19 for raising and lowering a sealing element is described in the following, with reference to FIGS. 9A to 9C. The sealing element 7A' can be a stripper element of a milling machine, which closes off the milling drum housing behind the milling drum, when seen in the operating direction. However, the sealing element can also be a stripper element of a stabiliser or recycler, which closes off the mixing drum housing behind the mixing drum when seen in the operating direction. A stabiliser is known, for example, from EP 1 012 396 B1.

Parts which correspond to the embodiment of FIGS. 1 to 8 are given the same reference symbols in the embodiment described with reference to FIGS. 9A to 9C.

The sealing element 7A', which is described in the following as stripper element, is shown only in a very simplified representation in FIGS. 9A to 9C, together with the piston/cylinder arrangement 20. The mechanism 19 for raising and lowering the stripper element 7A' comprises the control unit 23, the processing unit 24, and the measuring unit 26' as well as the hydraulic unit 21, which are connected to one another by data and control lines 25, 26.

Figure 9C:
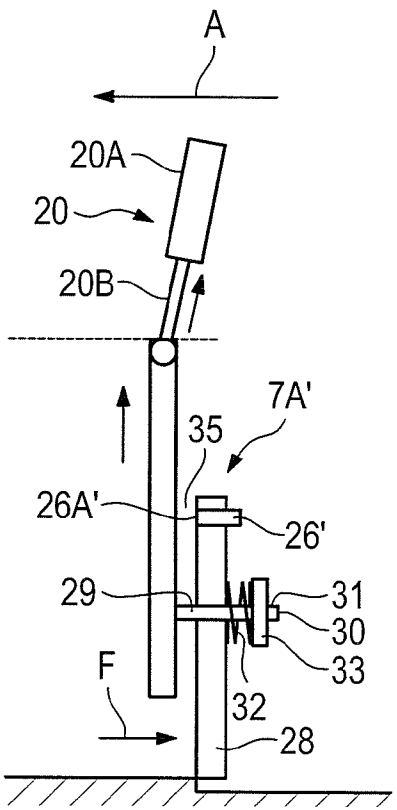
Figure 9B:
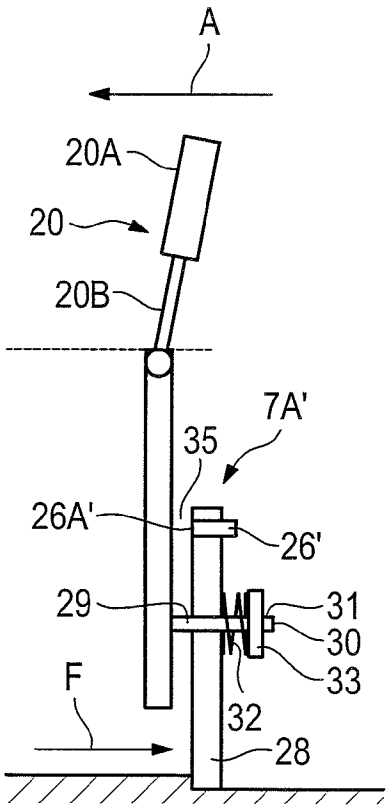
Figure 9A:
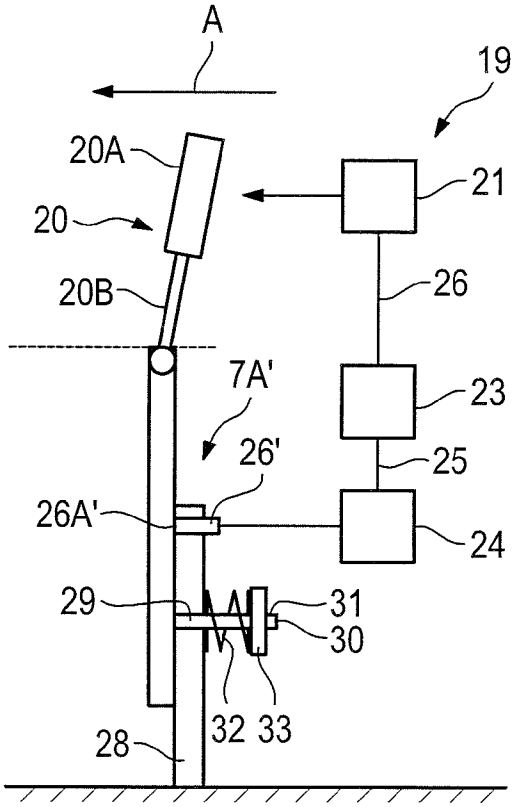

In the embodiment of FIG. 9A to 9C, a plate-like impact element 28 is fastened to the stripper element 7A', and can be a metal plate, which preferably extends over the whole width of the stripper element.

The impact element 28 has several spaced holes 29 in the upper part, through which guide pins 30 extend, at equal distances, each having an external thread 31. The impact element 28 is bolted to the stripper element 7A' with nuts 33, whereby compression springs 32 are positioned between the impact element 28 and the nuts 33, so that the impact element 28 is pre-loaded against the stripper element 7A'. The guide pins 30 with the nuts 33 and the springs 32 form a linear guide for the impact element 28, so that the impact element 28 can deviate from the position shown in FIG. 9A on impact with an obstacle in a direction opposite to the operating direction A.

FIG. 9B shows the instant in which the impact element 28 strikes an obstacle. On impact with the obstacle, the impact element 28 is displaced against the force of the compression springs 31, so that a gap 35 is formed between the stripper element and the impact element.

The measuring unit 26' has one or more sensors 26A', spaced apart from one other. The sensors 26A' are distance sensors, which detect if the impact element 28 is being moved backwards against the distance of travel A. In doing so, the force of the compression springs 32 determines the limit value of the force which must act during impact of the impact element with an obstacle in order to produce a control signal to raise the stripper element 7A'. At the instance of impact, the control unit 23 generates a first control signal for the hydraulic unit 21, which actuates the piston/cylinder arrangement 20, so that the stripper element 7A' is raised immediately.

FIG. 9C shows the position in which the lower edge of the stripper element 7A' is precisely at the height of the obstacle. At this instant, the compression springs 32 can force the impact element 28 against the stripper element 7A' again.

When the sensor or sensors 26A' detect again that the impact element 28 is in contact with the stripper element 7A' (FIG. 9A), the contact unit 22 generates a second control signal for the hydraulic unit 21, so that the piston/cylinder arrangement 20 presses the stripper element 7A' on the ground with a predetermined force.

Several, preferably two, sub-assemblies described in FIGS. 9A to 9C can also be positioned next to one another over the whole width of the operating drum, which can be a milling or mixing drum. A sub-division of the stripper element 27 into several segments offers advantages, in particular when entering bends, when only one of the two segments has to be raised.

Figure 10A:
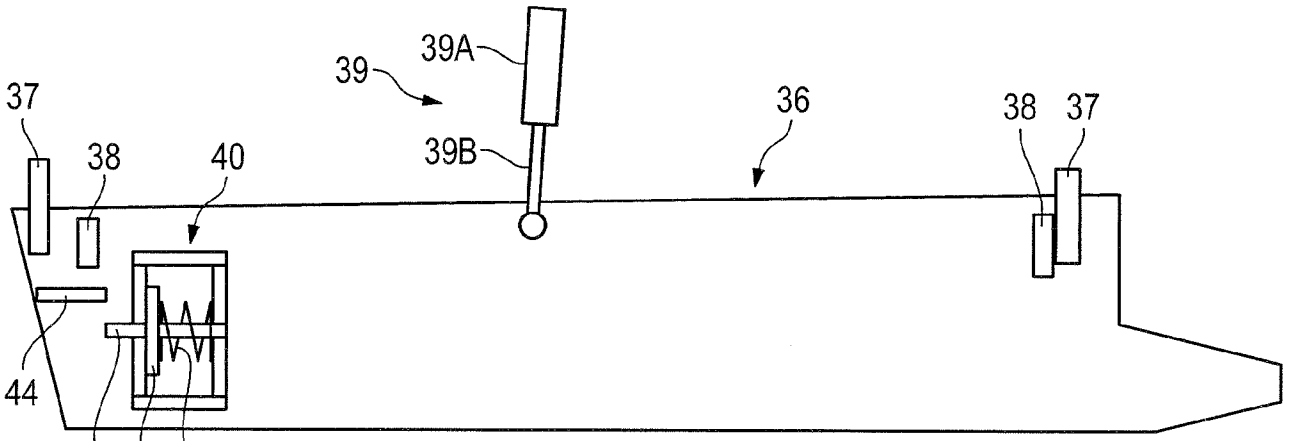
Figure 10B:
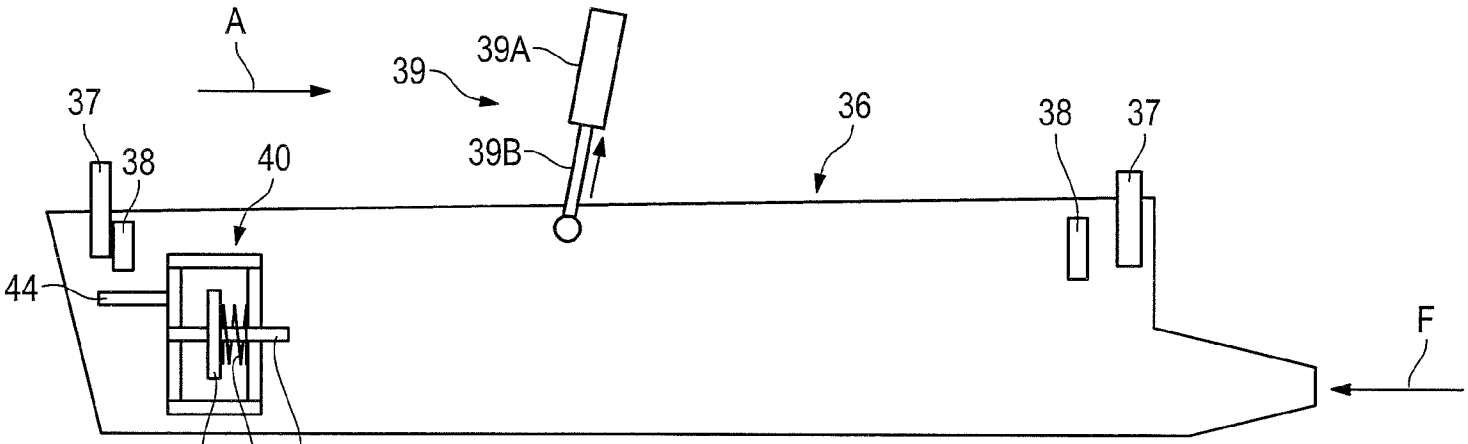

The sealing element that is automatically adjustable in height can also be one or both of the lateral sealing elements, which are described as edge protectors. FIGS. 10A and 10B show, in very simplified representation, the left or right edge protector, which extends in the operating direction. The edge protector 36 is a plate-like element, which is adjustable in height and is guided, slightly oscillating between two lateral stops 37. In FIGS. 10A and 10B, the lateral stops 37, which touch the lateral guides 38 of the machine frame, are shown only in outline.

The mechanism for raising and lowering the edge detector has a piston/cylinder arrangement 39, which is operated by the hydraulic unit, not shown in the Figures, to admit the hydraulic fluid to the cylinder 39A of the piston/cylinder arrangement 39. The cylinder 39A of the piston/cylinder arrangement 39 has an articulated connection to the machine frame, not shown, and the piston 39B has an articulated connection to the edge protector 36. When hydraulic fluid is admitted to the cylinder 39A, the edge protector can be raised and lowered.

The edge protector 36 is put under a spring preload in the operating direction A by a preloading device. The preloading device 40 comprises a guide 41 provided on the edge protector 36 and element 42 provided on the machine frame, whereby the element 42 provided on the machine frame is guided longitudinally with the guide 41 in or opposite to the operating direction. The edge protector 36 is preloaded in the operating direction with a compression spring 43, which is supported with one end on the edge protector 36 and the other end on the element 42 provided on the machine frame.

FIG. 10A shows the edge protector 36 in the preloaded initial position before impact with an obstacle. An essentially horizontal force F, which can have a frontal or lateral force component, is exerted on the edge protector on impact with an obstacle. The edge protector 36 then moves under spring preload opposite to the operating direction A so that the compression spring 43 is compressed (FIG. 10B). The edge protector 36 is thereby displaced by a certain distance. The displacement by the predetermined distance is detected by a sensor 44, so that a control signal is generated for the hydraulic unit, which actuates the hydraulic cylinder 39 to raise the edge protector. The edge protector 36 is raised until the obstacle has been negotiated. When the obstacle has been negotiated, the edge protector is displaced to return to its initial position, due to the restoring force of the compression spring 43, so that the edge protector is lowered again. Thus the restoring force of the compression spring 43 determines the impact force at which the edge protector is automatically raised.

Figure 11:
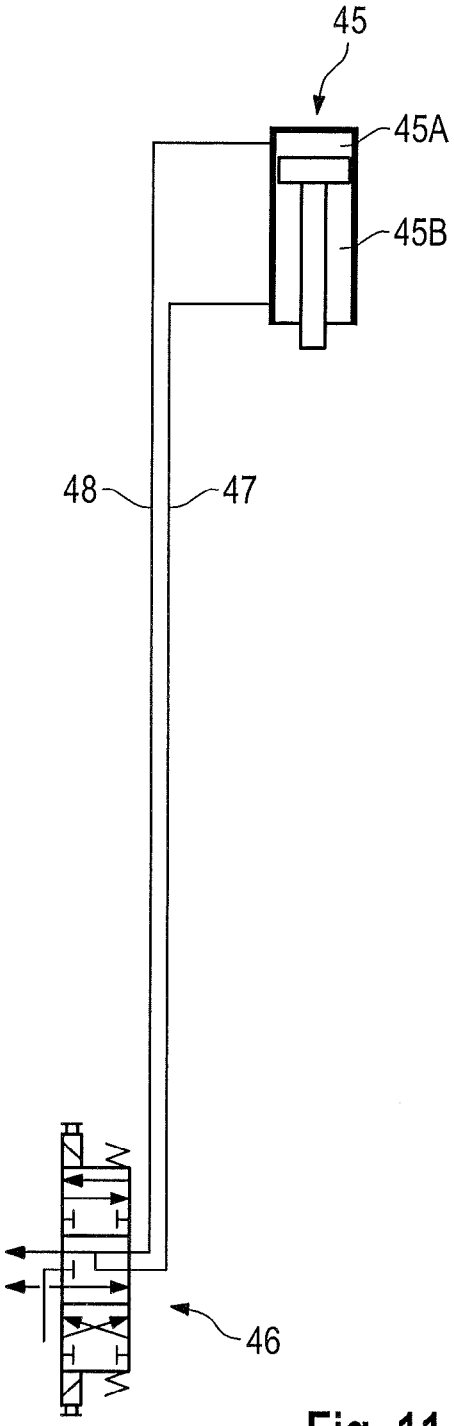

FIG. 11 shows a simplified hydraulic circuit, which shows the hydraulic cylinder 45 for raising or lowering a hold-down device or edge protector (not shown). During the forward movement of the construction machine, the hold-down device or edge protector is in a floating position, so that the hold-down device or edge protector rests on the ground with a predetermined force. In the floating position, the hydraulic valve 46 of the hydraulic unit connects the upper and lower cylinder chamber 45A and 45B of the hydraulic cylinder 45 by means of the hydraulic lines 47, 48 connected to the cylinder ports, for raising and lowering the hold-down device or edge protector, with a hydraulic tank (not shown), so that the chambers are not subjected to the system pressure. The hydraulic valve 46 is a 4/3 directional control valve. For simplicity, the hydraulic lines leading to the valve are not shown in FIG. 11. Since no specific hydraulic force acts on the cylinder, the piston can be displaced in the cylinder, so that the hold-down device or edge protector moves downwards due to its weight. When pressure is the same in both cylinder chambers, this movement downwards can still be supported through an appropriate configuration of the active contact surfaces of the hydraulic cylinder, when both chambers are subjected to a pressure in the floating position that preferably does not correspond to the system pressure, however. By switching over the hydraulic valve 46, one or the other hydraulic line 47, 48, can be subjected to system pressure (pressure line) or can be connected to the tank (tank line) so that the piston moves upwards or downwards. The hydraulic valve 46 is actuated depending on the measured impact force by the control unit, which is not shown in FIG. 11. On impact with an obstacle, the control unit generates a first control signal to activate the hydraulic valve 46, so that the lower cylinder chamber 45B is connected to the pressure line and the upper cylinder chamber 54A is connected to the tank line, raising the hold-down device or edge protector. If the measured force is less than the predetermined limit value, the control unit generates a second control signal, so that the hydraulic valve 46 is switched back to the floating position, which is shown in FIG. 11, so that the hold-down device or edge protector drops again. In an alternative embodiment, the hydraulic valve 46 connects the upper cylinder chamber 45A to the pressure line and the lower cylinder chamber 45B to the tank line, so that the hold-down device or edge protector is forced downward until the hold-down device or edge protection meets the ground. Only then does the control unit switch the hold-down device back to the floating position.

Figure 12:
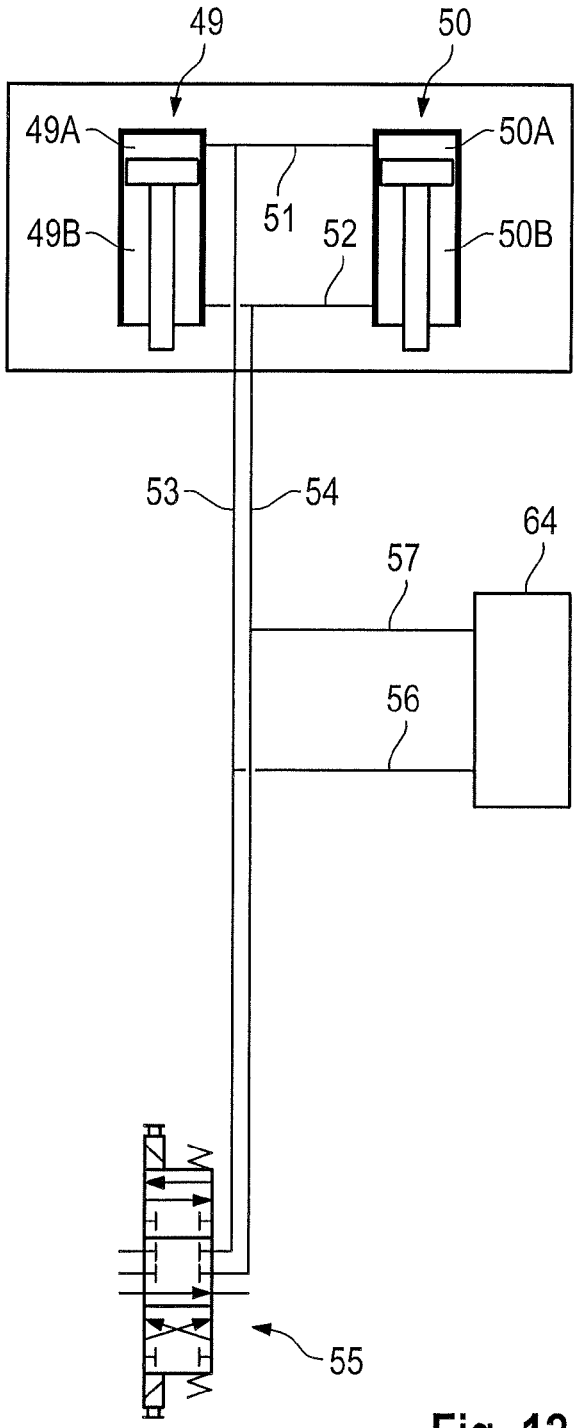

FIG. 12 shows the hydraulic circuit of a further embodiment of the hydraulic control system. This embodiment differs from the example embodiment according to FIG. 11, in that two cylinder-piston arrangements 49 and 50 are provided for raising and lowering the sealing element (not shown). A further difference lies in an additional hydraulic unit 51, with which a defined applied force is exerted on the sealing element, greater than the weight of the sealing element but less than the maximum operating force of the respective piston-cylinder arrangement. This applied force, with which the sealing element is pressed on the ground, has proved to be advantageous, in particularly with a stripper, since the stripper should remain in contact with the ground, even when it is irregular. In an alternative embodiment, the upper cylinder chambers 49A, 50A of the two piston-cylinder arrangements 49, 50 are short-circuited by means of a first hydraulic line 51 and lower cylinder chambers 49B, 50B of the piston-cylinder arrangements 49, 50 by means of a second hydraulic line 52. A third hydraulic line 53 leads from the first hydraulic line 51 and a fourth hydraulic line 54 leads from the second hydraulic line 52 to a hydraulic valve 55. To raise the hold-down device (not shown), the third hydraulic line 53 is connected by a tank line (not shown) and the fourth hydraulic line 54 to a pressure line (not shown). For this purpose, the control unit (not shown) actuates the hydraulic valve 55. During the forward movement of the construction machine, the ends of the third and fourth hydraulic lines 53, 54 are closed, and the hydraulic valve is in the position shown in FIG. 12. For this, the third hydraulic line 53 is connected to the pressure line 56 and the fourth hydraulic line 54 to the tank line 57 of the additional hydraulic unit 51, so that the hold-down device is pressed on the ground with the predetermined contact force. Since the contact force will be less than the maximum operating force of the piston-cylinder arrangement, the pressure in the pressure line 56 is less than the system pressure with which the piston-cylinder arrangements are operated. When an obstacle is detected, the control unit (not shown) again generates a control signal to actuate hydraulic valve 55, so that the hold-down device is released until the obstacle has been negotiated.

Figure 13:
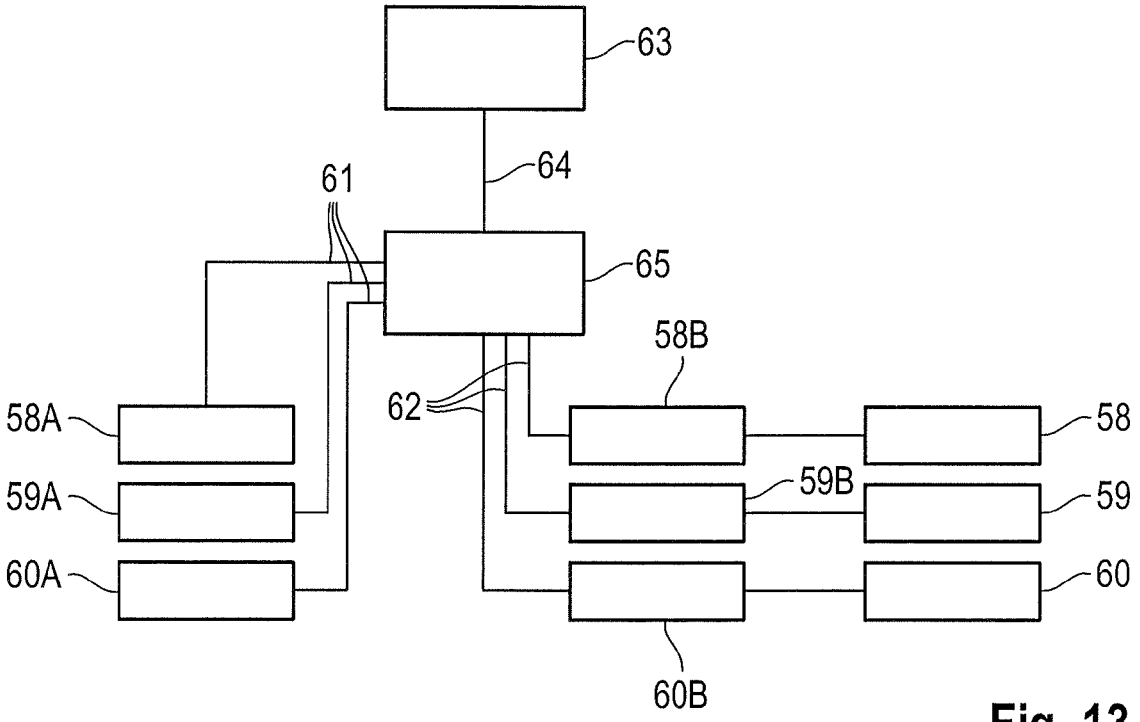

FIG. 13 shows, in greatly simplified schematic representation, an embodiment of the control system for an overload protection for a stripper 58, a hold-down device 59 and an edge protector 60. A measuring unit 58A, 59A, 60A is assigned to each of the stripper, hold-down device or edge protector, each of which is connected by means of a signal line 61 to a central control and processing unit 65. The control and processing unit 65 actuates the hydraulic valve associated with the stripper, hold-down device or edge protector by means of signal lines 62 as a function of the contact force measured by the respective measuring unit 58A, 59A, 60A, with which the piston-cylinder arrangement (not shown in FIG. 13) associated with the stripper, hold down device and edge protector is actuated. Furthermore, an operating unit 63 is provided, which is connected by means of data line 64 to the control and processing unit 65. The machine driver can switch off the automatic overload protection with the operating unit 63 and can adjust the height of the sealing elements 58, 59, 60 manually.

What is claimed is:

1. A self-propelled construction machine, comprising:

a machine frame;

an operating drum supported from the frame;

a drum housing surrounding the operating drum, the drum housing including at least one sealing element for closing the drum housing off to a ground surface;

an actuator configured to raise and lower the at least one sealing element relative to the operating drum, the actuator being configured so that the at least one sealing element contacts the ground surface with a predetermined contact force when the sealing element is not raised;

a sensor configured to detect a force acting on the at least one sealing element when the at least one sealing element encounters an obstacle; and a control unit, operatively connected to the sensor and the actuator and configured to generate a first control signal such that the actuator raises the at least one sealing element relative to the operating drum when the force detected by the sensor is greater than a predetermined limit value.

2. The self-propelled construction machine of claim 1, wherein:

the control unit is configured to generate a second control signal when the force detected by the sensor is less than the predetermined limit value, such that the at least one sealing element maintains its position or can be lowered relative to the operating drum and then rest on the ground surface with the predetermined contact force.

3. The self-propelled construction machine of claim 1, wherein the at least one sealing element comprises a front sealing element positioned in front of the operating drum in relation to an operating direction of the construction machine.

4. The self-propelled construction machine of claim 1, wherein the at least one sealing element comprises a rear sealing element positioned behind the operating drum in relation to an operating direction of the construction machine.

5. The self-propelled construction machine of claim 1, wherein the at least one sealing element comprises a lateral sealing element extending in an operating direction of the construction machine.

6. The self-propelled construction machine of claim 1, wherein the sensor is configured such that the sensor detects a horizontal force component of the force acting on the at least one sealing element.

7. The self-propelled construction machine of claim 1, wherein the actuator comprises at least one piston and cylinder arrangement, one of the piston and cylinder having an articulated connection to the machine frame, and the other of the piston and cylinder having an articulated connection to the at least one sealing element.

8. The self-propelled construction machine of claim 1, wherein:

the at least one sealing element comprises a lower edge and at least one impact element extending downwards past the lower edge.

9. The self-propelled construction machine of claim 8, wherein the at least one impact element is a plate-like impact element.

10. The self-propelled construction machine of claim 8, further comprising:

at least one hole defined in the at least one impact element; and at least one guide pin attached to the at least one sealing element and extending through the at least one hole in the at least one impact element.

11. The self-propelled construction machine of claim 8, wherein:

the at least one sensor is configured to detect a position of the at least one impact element.

12. The self-propelled construction machine of claim 1, wherein the construction machine is a road-milling machine and the operating drum is a milling drum.

13. A self-propelled construction machine comprising:

a machine frame;

an operating drum supported from the frame;

a drum housing surrounding the operating drum the drum housing including at least one sealing element for closing the drum housing off to a ground surface;

an actuator configured to raise and lower the at least one sealing element the actuator being configured so that the at least one sealing element contacts the ground surface with a predetermined contact force when the sealing element is not raised;

a sensor configured to detect a force acting on the at least one sealing element when the at least one sealing element encounters an obstacle; and a control unit operatively connected to the sensor and the actuator and configured to generate a first control signal such that the actuator raises the at least one sealing element when the force detected by the sensor is greater than a predetermined limit value;

wherein the at least one sealing element comprises a lower edge and at least one impact element extending downwards past the lower edge; and wherein the at least one impact element includes an upper part connected to the at least one sealing element under a spring preload so that on striking an obstacle the at least one impact element is displaced against the spring preload from a first position, in which the upper part of the at least one impact element is in contact with the at least one sealing element, to a second position in which the upper part of the at least one impact element is spaced from the at least one sealing element.

14. The self-propelled construction machine of claim 13, wherein:

the upper part of the at least one impact element is displaceably guided in a direction opposite to an operating direction of the construction machine.

15. The self-propelled construction machine of claim 13, wherein:

the upper part of the at least one impact element is guided displaceably on an axis perpendicular to a plane of the at least one sealing element.

16. A self-propelled construction machine, comprising:
a machine frame;
an operating drum supported from the frame;
a drum housing surrounding the operating drum, the drum housing including at least one sealing element for closing the drum housing off to a ground surface;
an actuator configured to raise and lower the at least one sealing element the actuator being configured so that the at least one sealing element contacts the ground surface with a predetermined contact force when the sealing element is not raised;
a sensor configured to detect a force acting on the at least one sealing element when the at least one sealing element encounters an obstacle; and
a control unit operatively connected to the sensor and the actuator and configured to generate a first control signal such that the actuator raises the at least one sealing element when the force detected by the sensor is greater than a predetermined limit value;
wherein the at least one sealing element comprises a lower edge and at least one impact element extending downwards past the lower edge; and
further comprising:
at least one hole defined in the at least one impact element; and
at least one guide pin attached to the at least one sealing element and extending through the at least one hole in the at least one impact element;
an external thread defined on the at least one guide pin;
a threaded nut threaded on the external thread of the at least one guide pin to hold the at least one impact element on the at least one guide pin; and
a spring positioned between the nut and the at least one impact element.

17. A self-propelled construction machine, comprising:
a machine frame;
an operating drum supported from the frame;
a drum housing surrounding the operating drum the drum housing including at least one sealing element for closing the drum housing off to a ground surface;
an actuator configured to raise and lower the at least one sealing element the actuator being configured so that the at least one sealing element contacts the ground surface with a predetermined contact force when the sealing element is not raised;
a sensor configured to detect a force acting on the at least one sealing element when the at least one sealing element encounters an obstacle; and
a control unit operatively connected to the sensor and the actuator and configured to generate a first control signal such that the actuator raises the at least one sealing element when the force detected by the sensor is greater than a predetermined limit value;
wherein:
the at least one sealing element comprises a lower edge and at least one impact element extending downwards past the lower edge;
the at least one sensor is configured to detect a position of the at least one impact element; and
the at least one sensor comprises a distance sensor configured to detect a distance between the at least one sealing element and the at least one impact element.

18. A self-propelled construction machine, comprising:
a machine frame;
an operating drum supported from the frame;
a drum housing surrounding the operating drum the drum housing including at least one sealing element for closing the drum housing off to a ground surface;
an actuator configured to raise and lower the at least one sealing element the actuator being configured so that the at least one sealing element contacts the ground surface with a predetermined contact force when the sealing element is not raised;
a sensor configured to detect a force acting on the at least one sealing element when the at least one sealing element encounters an obstacle; and
a control unit operatively connected to the sensor and the actuator and configured to generate a first control signal such that the actuator raises the at least one sealing element when the force detected by the sensor is greater than a predetermined limit value;
wherein:
the at least one sealing element comprises first and second rear sealing elements positioned behind the operating drum in relation to an operating direction of the construction machine; and
the actuator comprises first and second actuators configured to raise and lower the first and second rear sealing elements, respectively, the first and second actuators operating independently of each other.

19. A method of controlling a height-adjustable sealing element configured to close off a drum housing of a self-propelled construction machine from a ground surface, the machine including a working drum received in the drum housing for working the ground surface, wherein the sealing element is configured to rest on the ground surface with a predetermined contact force, the method comprising:
detecting a force acting on the sealing element when the sealing element encounters an obstacle; and
raising the sealing element relative to the working drum when the detected force exceeds a predetermined limit value.

20. The method of claim 19, further comprising:
maintaining a position of the sealing element or lowering the sealing element so that the sealing element rests on the ground surface with the predetermined contact force when the detected force acting on the sealing element is less than the predetermined limit value.

* * * * *